US012781296B2

(12) United States Patent
Hashimoto et al.

(10) Patent No.: US 12,781,296 B2
(45) Date of Patent: Nov. 3, 2026

(54) OPERATION GUIDANCE METHOD, BLAST FURNACE OPERATION METHOD, HOT METAL MANUFACTURING METHOD, AND OPERATION GUIDANCE APPARATUS

(71) Applicant: JFE STEEL CORPORATION, Tokyo (JP)

(72) Inventors: Yoshinari Hashimoto, Tokyo (JP); Ryosuke Masuda, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 988 days.

(21) Appl. No.: 18/011,732

(22) PCT Filed: Jun. 15, 2021

(86) PCT No.: PCT/JP2021/022619
§ 371 (c)(1),
(2) Date: Dec. 20, 2022

(87) PCT Pub. No.: WO2022/009621
PCT Pub. Date: Jan. 13, 2022

(65) Prior Publication Data

US 2023/0313329 A1 Oct. 5, 2023

(30) Foreign Application Priority Data

Jul. 6, 2020 (JP) ..... 2020-116370

(51) Int. Cl.
*C21B 7/24* (2006.01)
*C21B 5/00* (2006.01)

(52) U.S. Cl.
CPC ..... *C21B 7/24* (2013.01); *C21B 5/006* (2013.01); *C21B 2300/04* (2013.01)

(58) Field of Classification Search
CPC ..... C21B 7/24; C21B 5/006; C21B 2300/04
See application file for complete search history.

(56) References Cited

U.S. PATENT DOCUMENTS 4,227,921 A * 10/1980 Matoba ..... C21B 5/006 75/384
8,377,169 B2 2/2013 Tokuda et al.
(Continued)

FOREIGN PATENT DOCUMENTS

CN 101528949 A 9/2009
CN 102952910 A 3/2013
(Continued)

OTHER PUBLICATIONS

JP 2018009224, Narasaki et al., Jan. 18, 2018 (Machine Translation).*
(Continued)

*Primary Examiner* — Courtney D Heinle
(74) *Attorney, Agent, or Firm* — Oliff PLC

(57) ABSTRACT

An operation guidance method includes: predicting a state in a blast furnace when a current operation state is retained in a future, by using a physical model that is able to calculate the state in the blast furnace; and displaying, on an output device, an oxygen balance in a raceway region, a carbon balance in an entire furnace, and an oxygen balance derived from iron oxide in the entire furnace, when the state in the blast furnace is predicted.

14 Claims, 16 Drawing Sheets

(56) References Cited

U.S. PATENT DOCUMENTS

| | | | | |
|---|---|---|---|---|
| 2010/0313710 | A1* | 12/2010 | Tokuda | F27D 7/06 75/364 |
| 2015/0275321 | A1* | 10/2015 | Ichikawa | C21B 5/006 75/380 |

FOREIGN PATENT DOCUMENTS

| | | | |
|---|---|---|---|
| CN | 104593532 | A | 5/2015 |
| CN | 104781426 | A | 7/2015 |
| CN | 109918702 | A | 6/2019 |
| CN | 110322057 | A | 10/2019 |
| JP | S54-114413 | A | 9/1979 |
| JP | H01-319614 | A | 12/1989 |
| JP | H11-106807 | A | 4/1999 |
| JP | H11-335710 | A | 12/1999 |
| JP | 2010-255092 | A | 11/2010 |
| JP | 2017-008363 | A | 1/2017 |
| JP | 2018-9224 | A | 1/2018 |
| JP | 2018-024935 | A | 2/2018 |
| JP | 2020-029596 | A | 2/2020 |
| JP | 2020-066753 | A | 4/2020 |
| KR | 10-0381094 | B1 | 7/2003 |
| KR | 10-2020-0022207 | A | 3/2020 |
| WO | 2011/087036 | A1 | 7/2011 |

OTHER PUBLICATIONS

KR 100381094, Kim et al., Jul. 22, 2003 (Machine Translation).*
WO 2011087036, Kato, Jul. 21, 2011 (Machine Translation).*
JP 2020066753, Nakano, Apr. 30, 2020 (Machine Translation).*
Mar. 27, 2024 Office Action Issued in Chinese Patent Application No. 202180047086.1.
Jul. 28, 2025 Office Action issued in Korean Patent Application No. 10-2022-7046242.
Spanlang Andreas et al. "Development of a Blast Furnace Model with Thermodynamic Process Depiction by Means of the Rist Operating Diagram". Berg Huettenmaenn Monatsh vol. 165 (5), 243-247, Feb. 17, 2020.
Jun. 14, 2024 Office Action issued in Chinese Patent Application No. 202180047086.1.
Oct. 23, 2024 Office Action issued in Korean Patent Application No. 10-2022-7046242.
Aug. 3, 2021 International Search Report issued in International Patent Application No. PCT/JP2021/022619.
Feb. 11, 2022 Taiwanese Office Action issued in Taiwanese Patent Application No. 110123518.
Nov. 22, 2022 Office Action issued in Japanese Patent Application No. 2020-116370.
Michiharu Hatano et al., "Investigation of Blow-in Operation through the Blast Furnace Dynamic Model", Iron and Steel, vol. 68, (1982), pp. 2369-2376.
Oct. 17, 2023 extended Search Report issued in European Patent Application No. 21838845.2.
Oct. 24, 2023 Office Action issued in Chinese Patent Application No. 202180047086.1.

* cited by examiner

| BLAST AIR FLOW RATE BV | ENRICHED OXYGEN FLOW RATE BVO | COKE RATIO CR | PULVERIZED COAL FLOW RATE PCI | BLAST AIR MOISTURE BM | BLAST AIR TEMPER-ATURE BT |
|---|---|---|---|---|---|
| 6770 | 280 | 390 | 970 | 26 | 1150 |
| $Nm^3$/min | $Nm^3$/min | kg/t | kg/min | g/$Nm^3$ | ℃ |

OPERATION GUIDANCE METHOD, BLAST FURNACE OPERATION METHOD, HOT METAL MANUFACTURING METHOD, AND OPERATION GUIDANCE APPARATUS

FIELD

The present invention relates to an operation guidance method, a blast furnace operation method, a hot metal manufacturing method, and an operation guidance apparatus.

BACKGROUND

In a blast furnace process in the iron industry, a hot metal temperature and a hot metal production rate (hereinafter referred to as "hot metal making rate") are important management indexes. When the hot metal temperature increases, not only a surplus reduction material is consumed, but also descent of a raw material becomes unstable due to expansion of gas in a furnace. In addition, when the hot metal temperature extremely decreases, a slag discharging property is deteriorated, and a productivity of the blast furnace remarkably decreases. An operator mainly operates blast air moisture and a pulverized coal ratio in order to control the hot metal temperature. On the other hand, in the blast furnace, it is required to perform the operation in compliance with a target hot metal making rate designated by a subsequent process. In order to control the hot metal making rate, a blast air flow rate and an enriched oxygen flow rate are adjusted.

In addition, since the blast furnace process is operated in a state of being filled with a solid, the blast furnace process has characteristics that a heat capacity of an entire process is large and a time constant of a response to the operation (operational action) is long. Furthermore, there is a dead time to an extent of several hours until the raw material charged from an upper part (furnace top) of the blast furnace falls to a lower part (furnace bottom) of the blast furnace. Therefore, in order to properly operate the blast furnace, it is necessary to determine the operational action based on a future state of the blast furnace.

For this reason, Patent Literature 1 proposes a method for controlling the blast furnace based on future prediction using a physical model. In the method for controlling the blast furnace described in Patent Literature 1, a gas reduction speed parameter included in the physical model is adjusted so as to match a current gas composition in the furnace top, and a furnace heat is predicted using the physical model after adjusting the parameter.

CITATION LIST

Patent Literature

Patent Literature 1: JP H11-335710 A

SUMMARY

Technical Problem

However, the physical model used in Patent Literature 1 predicts a hot metal temperature and a hot metal making rate based on a complicated mathematical formula such as a partial differential equation. Therefore, it is difficult to understand the calculation basis from a viewpoint of an operator engaged in the operation. The physical model has been a barrier in the reliable use of a control system.

In addition, there is a phenomenon that is difficult to predict by the current physical model, such as blow-through of furnace gas due to deterioration of air permeability caused by powderization of raw materials and generation of unburned pulverized coal, and thus it is currently difficult to achieve complete automation of the blast furnace operation. Therefore, it is considered that a human machine cooperation technology for enhancing skills of the operator is also necessary. However, the control system based on the physical model as described above cannot sufficiently cope with this problem.

The present invention has been made in view of the above, and an object of the present invention is to provide an operation guidance method, a blast furnace operation method, a hot metal manufacturing method, and an operation guidance apparatus that can guide the operator to take an appropriate operational action in consideration of an in-furnace state.

Solution to Problem

To solve the problem and achieve the object, an operation guidance method according to the present invention includes: a first prediction step of predicting a state in a blast furnace when a current operation state is retained in a future, by using a physical model that is able to calculate the state in the blast furnace; and a display step of displaying, on an output device, an oxygen balance in a raceway region, a carbon balance in an entire furnace, and an oxygen balance derived from iron oxide in the entire furnace, when the state in the blast furnace is predicted.

Moreover, in the operation guidance method according to the present invention, in the display step, a current state and a state when the current operation state is retained in the future are displayed side by side in a comparable manner with respect to the oxygen balance in the raceway region, the carbon balance in the entire furnace, and the oxygen balance derived from iron oxide in the entire furnace.

Moreover, the operation guidance method according to the present invention further includes a second prediction step of predicting, by using the physical model, a future state in the blast furnace when an operation is performed under an arbitrary virtual operating condition which is input by an operator, wherein in the display step, the current state and a state when the operation is performed under the virtual operating condition are displayed side by side in a comparable manner on a graph with respect to the oxygen balance in the raceway region, the carbon balance in the entire furnace, and the oxygen balance derived from iron oxide in the entire furnace.

Moreover, in the operation guidance method according to the present invention, in the second prediction step, the output device displays an input interface that is able to designate an arbitrary value of a plurality of operation variables indicating the operating condition, and the future state in the blast furnace is predicted based on the plurality of operation variables designated by the input interface.

Moreover, in the operation guidance method according to the present invention, the oxygen balance in the raceway region indicates a relationship between a supply speed of oxygen blown into the raceway region and a consumption speed of carbon burned in the raceway region, the carbon balance in the entire furnace indicates a relationship between a supply speed of carbon derived from coke supplied from a furnace top and a consumption speed of carbon burned in a furnace, the oxygen balance derived from iron oxide in the entire furnace indicates a relationship among a charging speed of iron derived from iron oxide supplied from the furnace top, a charging speed of oxygen derived from iron oxide supplied from the furnace top, and a reduction reaction speed of iron oxide, by gas, supplied from the furnace top, and in the display step, the oxygen balance in the raceway region, the carbon balance in the entire furnace, and the oxygen balance derived from iron oxide in the entire furnace, except for the charging speed of iron derived from iron oxide, are displayed side by side in a first axis direction on the graph, and the charging speed of iron derived from iron oxide is displayed in a second axis direction orthogonal to the first axis direction.

Moreover, in the operation guidance method according to the present invention, in the display step, a change before and after prediction of an operation index, predicted in at least one of the first prediction step and the second prediction step, is displayed in a comparable manner, where the operation index includes an operation state of: a hot metal making rate; a coke ratio; and a pulverized coal flow ratio.

Moreover, in the operation guidance method according to the present invention, the display step includes displaying a heat balance in the furnace indicating a relationship between heat input into the furnace and heat consumed in the furnace, in addition to the oxygen balance in the raceway region, the carbon balance in the entire furnace, and the oxygen balance derived from iron oxide in the entire furnace.

Moreover, in the operation guidance method according to the present invention, the display step displays each balance by converting each balance in terms of a value per unit weight of hot metal.

Moreover, a blast furnace operation method according to the present invention includes a step of controlling a blast furnace based on guidance according to the operation guidance method according to the present invention.

Moreover, a hot metal manufacturing method according to the present invention includes a step of manufacturing hot metal by controlling a blast furnace based on guidance according to the operation guidance method according to the present invention.

Moreover, an operation guidance apparatus according to the present invention includes: a prediction unit configured to predict a state in a blast furnace when a current operation state is retained in a future, by using a physical model that is able to calculate the state in the blast furnace; and a display unit configured to display an oxygen balance in a raceway region, a carbon balance in an entire furnace, and an oxygen balance derived from iron oxide in the entire furnace, when the state in the blast furnace is predicted.

Advantageous Effects of Invention

The operation guidance method, the blast furnace operation method, the hot metal manufacturing method, and the operation guidance apparatus according to the present invention display an oxygen balance in a raceway region, a carbon balance in an entire furnace, and an oxygen balance derived from iron oxide in the entire furnace when a state in the blast furnace is predicted. As a result, the operator is guided to take an appropriate operational action. Therefore, a highly efficient and stable operation of the blast furnace can be realized.

DESCRIPTION OF EMBODIMENTS

An operation guidance method, a blast furnace operation method, a hot metal manufacturing method, and an operation guidance apparatus according to an embodiment of the present invention will be described with reference to the drawings.

[Configuration of Operation Guidance Apparatus]

Figure 1:
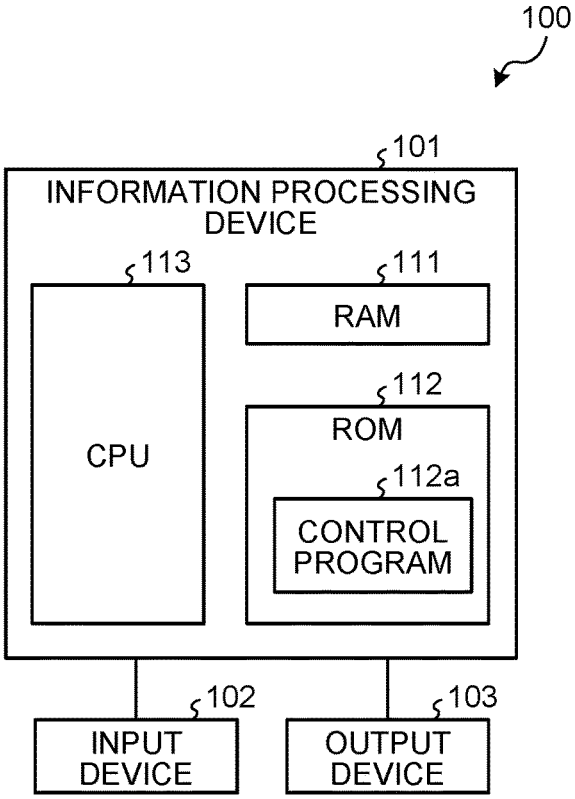
FIG. 1 is a block diagram illustrating a schematic configuration of an operation guidance apparatus according to an embodiment of the present invention.

A configuration of an operation guidance apparatus according to the embodiment of the present invention will be described with reference to FIG. 1. An operation guidance apparatus 100 includes an information processing device 101, an input device 102, and an output device 103.

The information processing device 101 is configured with a general-purpose device such as a personal computer or a workstation, and includes a RAM 111, a ROM 112, and a CPU 113. The RAM 111 temporarily stores a processing program and processing data related to processing executed by the CPU 113 and functions as a working area of the CPU 113.

The ROM 112 stores a control program 112*a* for executing the operation guidance method according to the embodiment of the present invention, and the processing program and the processing data for controlling the entire operation of the information processing device 101.

The CPU 113 controls the entire operation of the information processing device 101 according to the control program 112*a* and the processing program stored in the ROM 112. The CPU 113 functions as a first prediction unit that performs a first prediction step, a second prediction unit that performs a second prediction step, and a display unit that performs a display step in the operation guidance method to be described later.

The input device 102 includes devices such as a keyboard, a mouse pointer, and a numeric keypad, and is operated to input various types of information to the information processing device 101. The output device 103 includes a display device, a printing device, and the like, and outputs various types of processed information of the information processing device 101. The output device 103 displays an oxygen balance in a raceway region, a carbon balance in an entire furnace, an oxygen balance derived from iron oxide in the entire furnace, a heat balance in the furnace, and the like in the operation guidance method to be described later. The "raceway region" refers to a region at about 2000° C. where coke in the furnace is burned by oxygen in hot air blown from a tuyere.

[Configuration of Physical Model]

Next, a physical model used in the operation guidance method according to the embodiment of the present invention will be described. Similarly to a method described in Reference Literature 1 (Michiharu Hatano et al., "Investigation of Blow-in Operation through the Blast Furnace Dynamic Model", Iron and Steel, vol. 68, p. 2369), the physical model used in the present invention includes a partial differential equation group considering a plurality of physical phenomena such as reduction of iron ore, heat exchange between iron ore and coke, and melting of iron ore. In addition, the physical model used in the present invention is a physical model capable of calculating a variable (output variable) indicating a state in the blast furnace in a non-steady state (hereinafter referred to as a "dynamic model").

Figure 2:
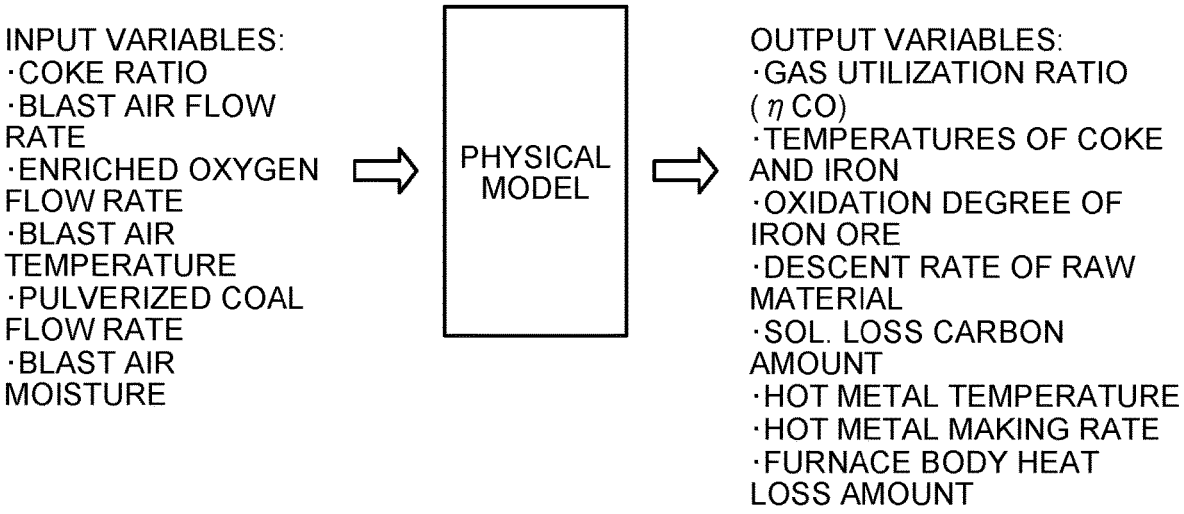
FIG. 2 is a diagram illustrating an example of an input variable and an output variable of a physical model used in an operation guidance method according to the embodiment of the present invention.

As illustrated in FIG. 2, major time-varying conditions (input variables, blast furnace operation variables (also referred to as operational factors)) among boundary conditions given to the dynamic model are as follows.

(1) Coke ratio (CR) at furnace top [kg/t]: Coke input per ton of hot metal
(2) Blast air flow rate (BV) [$Nm^3$/min]: Flow rate of air supplied to the blast furnace
(3) Enriched oxygen flow rate (BVO) [$Nm^3$/min]: Flow rate of enriched oxygen blown into the blast furnace
(4) Blast temperature (BT) [° C.]: Temperature of air and enriched oxygen supplied to the blast furnace
(5) Pulverized coal flow rate (pulverized coal blowing rate, PCI) [kg/min]: Weight of pulverized coal used for one ton of hot metal production
(6) Blast air moisture (BM) [g/$Nm^3$]: Moisture of air supplied to the blast furnace In addition, major output variables formed by the dynamic model are as follows.

(1) Gas utilization ratio in the furnace (ηCO): $CO_2/(CO+CO_2)$
(2) Temperature of coke and iron
(3) Oxidation degree of iron ore
(4) Descent rate of raw material
(5) Solution-loss carbon amount (sol. loss carbon amount)
(6) Hot metal temperature
(7) Hot metal making rate (hot metal production speed)
(8) Furnace body heat loss amount: Amount of heat deprived by cooling water when the furnace body is cooled by cooling water In the present invention, a time step (time interval) for calculating the output variables is 30 minutes. However, the time step can be changed according to the purpose, and is not limited to the value of the present embodiment.

The dynamic model described above can be expressed, for example, by the following formulas (1) and (2). By using this dynamic model, it is possible to calculate the output variables including momentarily changing hot metal temperature and hot metal making rate.

$$x(t+1)=f(x(t),u(t)) \quad (1)$$

$$y(t)=C(x(t)) \quad (2)$$

Here, in the above formulas (1) and (2), x(t) is a state variable (temperature of coke or iron, oxidation degree of iron ore, descent rate of raw material, and the like) calculated in the dynamic model, and y(t) is a control variable such as a hot metal temperature (HMT) and the hot metal making rate. In addition, C is a matrix or a function for extracting the control variable from state variables calculated in the dynamic model.

In addition, u(t) in the above formula (1) is an input variable in the dynamic model such as the blast air flow rate, the enriched oxygen flow rate, the pulverized coal flow rate, the blast air moisture, the blast temperature, and the coke ratio. This u(t) can be expressed by "u(t)=(BV(t), BVO(t), PCI(t), BM(t), BT(t), or CR(t))".

[Operation Guidance Method]

Next, the operation guidance method according to the present embodiment will be described. The operation guidance method according to the present embodiment performs the first prediction step, the second prediction step, a balance calculation step, and the display step. Either the first prediction step or the second prediction step may be performed first. In addition, both the first prediction step and the second prediction step are not necessarily performed, and either one may be performed.

(First Prediction Step)

In the first prediction step, the dynamic model described above is used to predict a state in the blast furnace at an arbitrary future time when the current operation state is retained in the future. Examples of the state in the blast furnace predicted in this step are the hot metal temperature, the hot metal making rate, air permeability of the blast furnace, and a pressure loss indicating a difference between the pressure at the furnace top and the pressure at the tuyere. In the present embodiment, a case where the hot metal temperature and the hot metal making rate are predicted in this step will be described. A specific example of the first prediction step will be described later.

(Second Prediction Step)

In the second prediction step, the dynamic model described above is used to predict a future state inside the blast furnace when the operation is performed under arbitrary virtual operating conditions input by the operator. In this step, for example, the output device 103 displays an input interface (FIG. 15) that can designate arbitrary values of a plurality of operation variables indicating the operating conditions, and the state in the blast furnace at an arbitrary future time is predicted based on the values of the operation variables designated by the operator. In the present embodiment, a case where the hot metal temperature and the hot metal making rate are predicted in this step will be described. A specific example of the second prediction step will be described later.

(Balance Calculation Step)

In the balance calculation step, a material balance and a heat balance in the furnace are calculated. The material balance in the furnace includes the oxygen balance in the raceway region, the carbon balance in the entire furnace, and the oxygen balance derived from iron oxide in the entire furnace.

Figure 3:
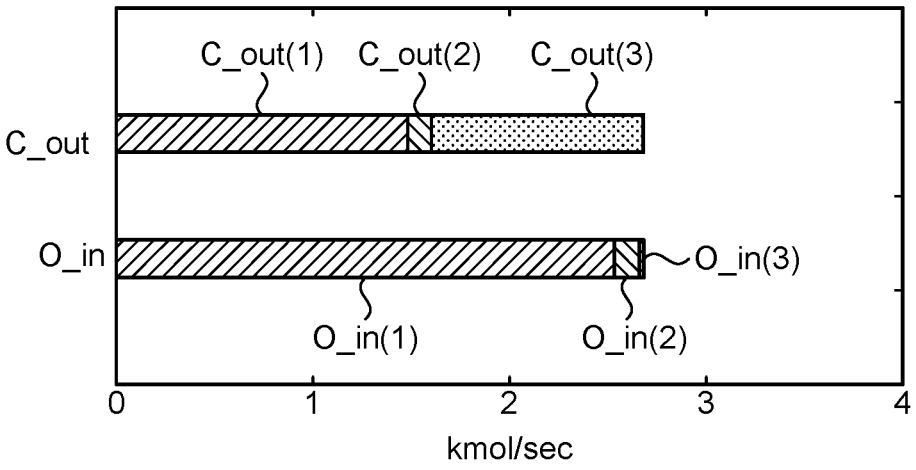
FIG. 3 is a graph illustrating an oxygen balance in a raceway region.
Figure 4:
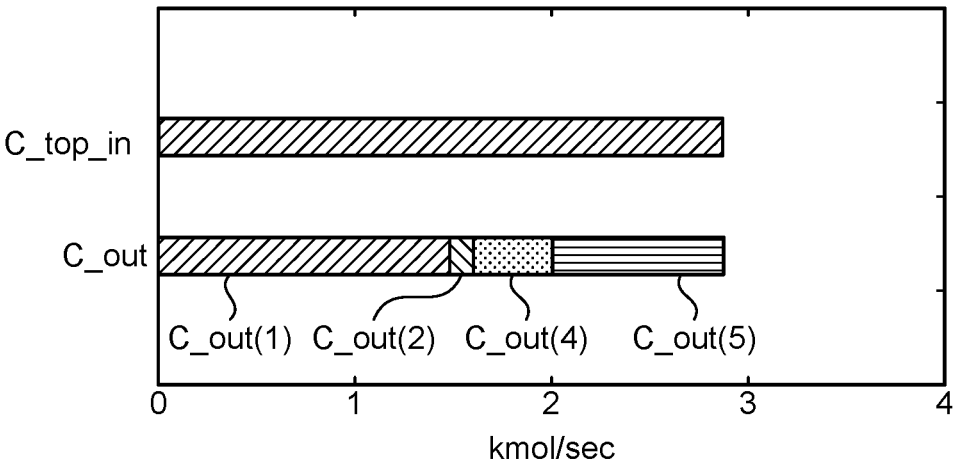
FIG. 4 is a graph illustrating a carbon balance derived from coke in an entire furnace.

The oxygen balance in the raceway region indicates a relationship between a supply speed of oxygen blown into the raceway region and a consumption speed of carbon burned in the raceway region (FIG. 3 to be described later). In addition, the carbon balance in the entire furnace indicates a relationship between a supply speed of carbon derived from coke supplied from the furnace top and the consumption speed of carbon burned in the furnace (FIG. 4 to be described later).

Figure 5:
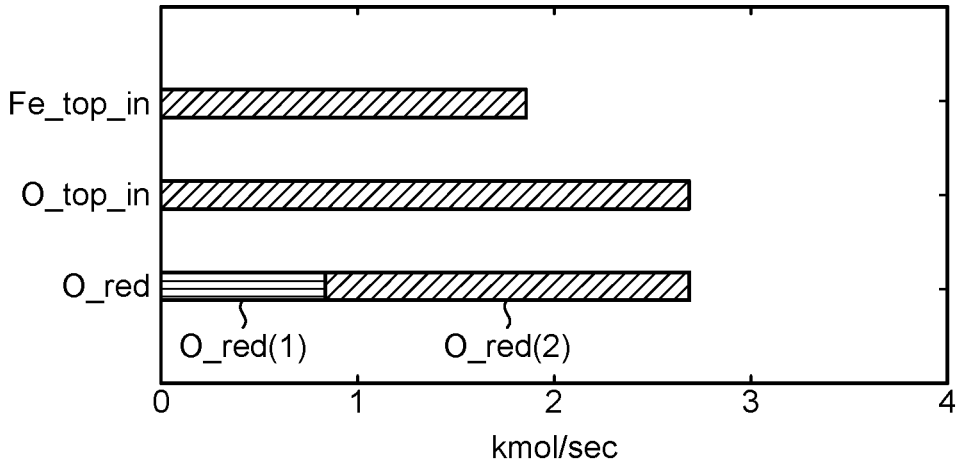
FIG. 5 is a graph illustrating an oxygen balance derived from iron oxide in the entire furnace.
Figure 7:
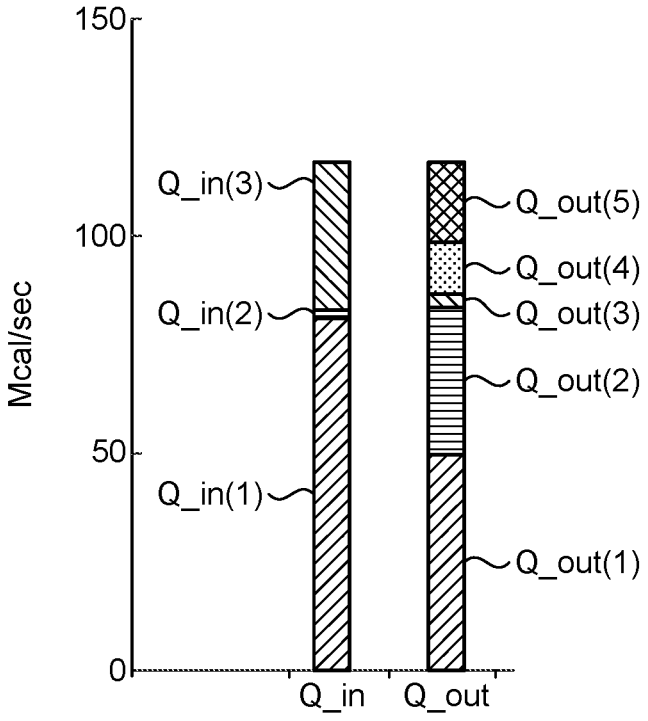
FIG. 7 is a graph illustrating a heat balance in the furnace per unit time.

In addition, the oxygen balance derived from iron oxide indicates a relationship among a charging speed of iron derived from iron oxide supplied from the furnace top, a charging speed of oxygen derived from iron oxide supplied from the furnace top, and a reduction reaction speed of iron oxide supplied from the furnace top by gas (FIG. 5 to be described later). The heat balance in the furnace indicates a relationship between a heat input into the furnace and a heat consumed in the furnace (FIG. 7 to be described later).

Specifically, this step calculates the current material balance and heat balance, the material balance and the heat balance at the arbitrary future time when the state in the blast furnace is predicted in the first prediction step, and the material balance and the heat balance at the arbitrary time when the state in the blast furnace is predicted in the second prediction step. Note that details of each balance calculated in the balance calculation step will be described later (FIGS. 3 to 9, FIGS. 11 to 14, and FIGS. 15 to 19 to be described later).

(Display Step)

In the display step, each balance calculated in the balance calculation step is displayed on the output device 103 and presented to the operator. In this step, the output device 103 displays the current material balance and the heat balance, the material balance and the heat balance at the arbitrary future time when the state in the blast furnace is predicted in the first prediction step, and the material balance and the heat balance at any future time when the state in the blast furnace is predicted in the second prediction step. Note that details of each balance calculated to display in the display step will be described later (FIGS. 11 to 14 and FIGS. 16 to 19 described later).

Figure 11:
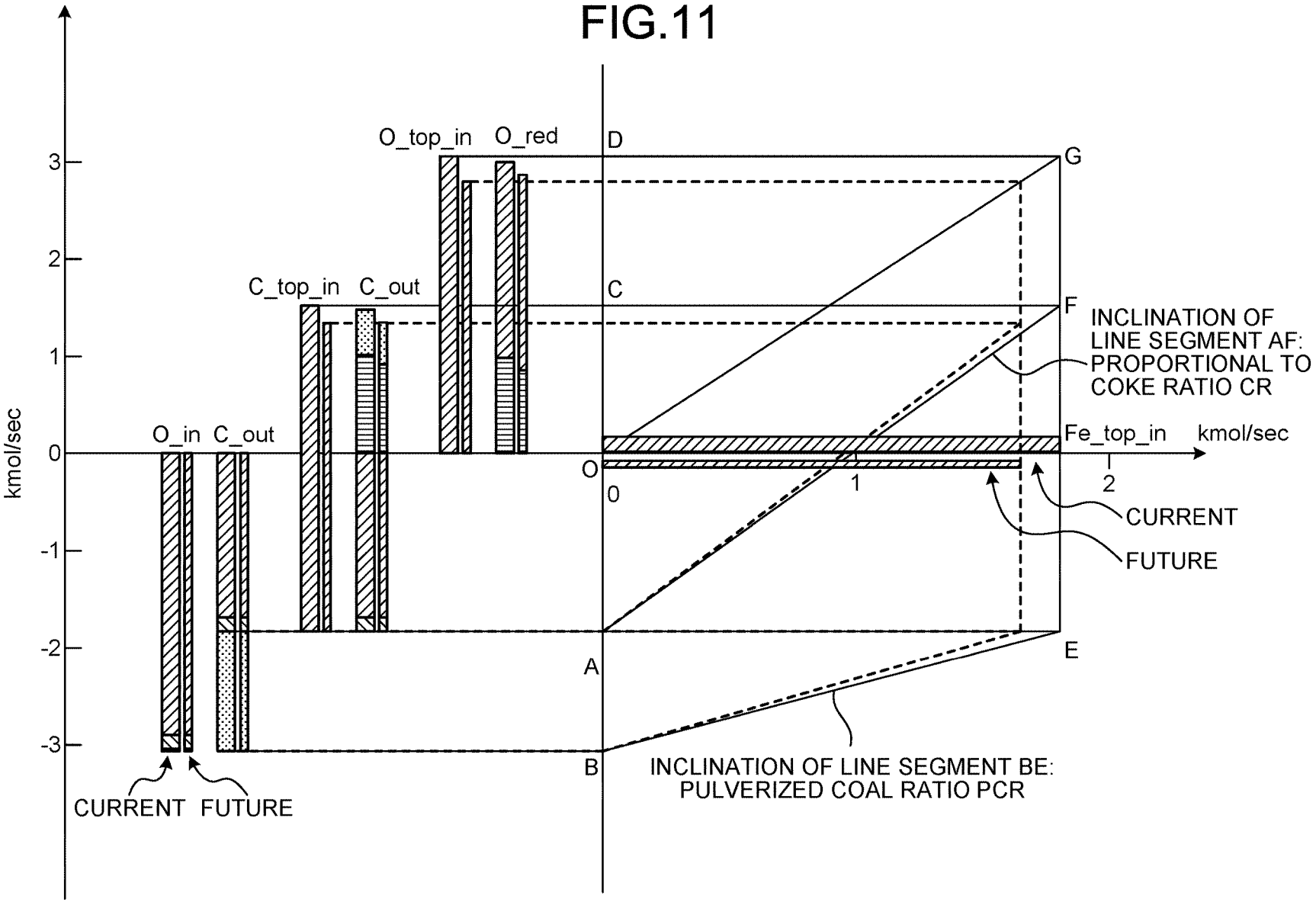
FIG. 11 is a graph illustrating the material balance in the furnace per unit time and values before and after increasing a coke ratio.
Figure 13:
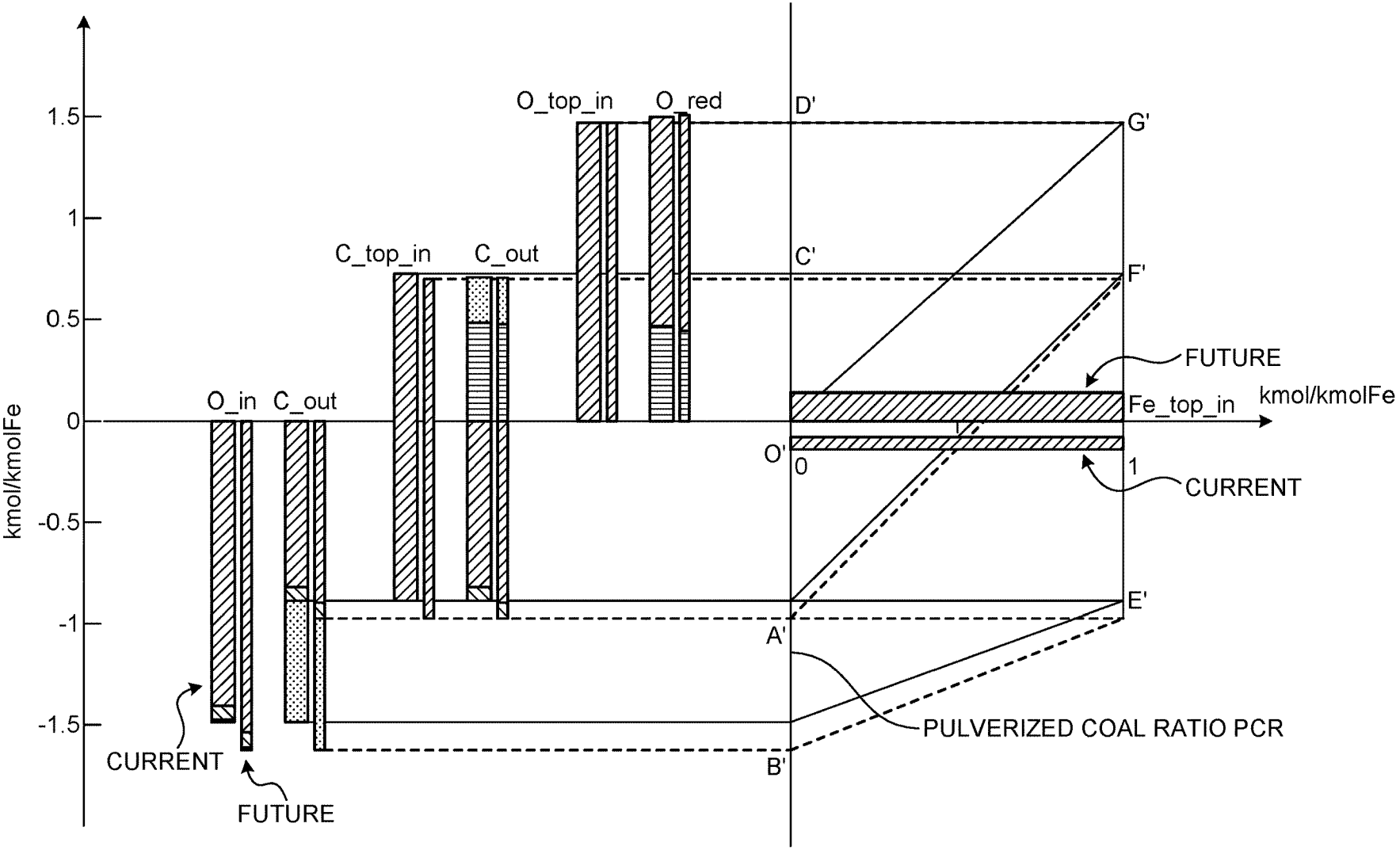
FIG. 13 is a graph illustrating the material balance in the furnace per unit weight of hot metal and values before and after increasing the coke ratio.

When the first prediction step is performed, the oxygen balance in the raceway region, the carbon balance in the entire furnace, and the oxygen balance derived from iron oxide in the entire furnace are displayed in this step as follows. In other words, with respect to these balances, the current state and a state when the current operation state is retained in the future are displayed side by side in a comparable manner along a same axis direction in one graph in this step (FIGS. 11 and 13). As a result, it is possible to visually present to the operator the material balance in the furnace when the current operation state is retained in the future, so that the operator can be easily guided to take an appropriate operational action.

Figure 16:
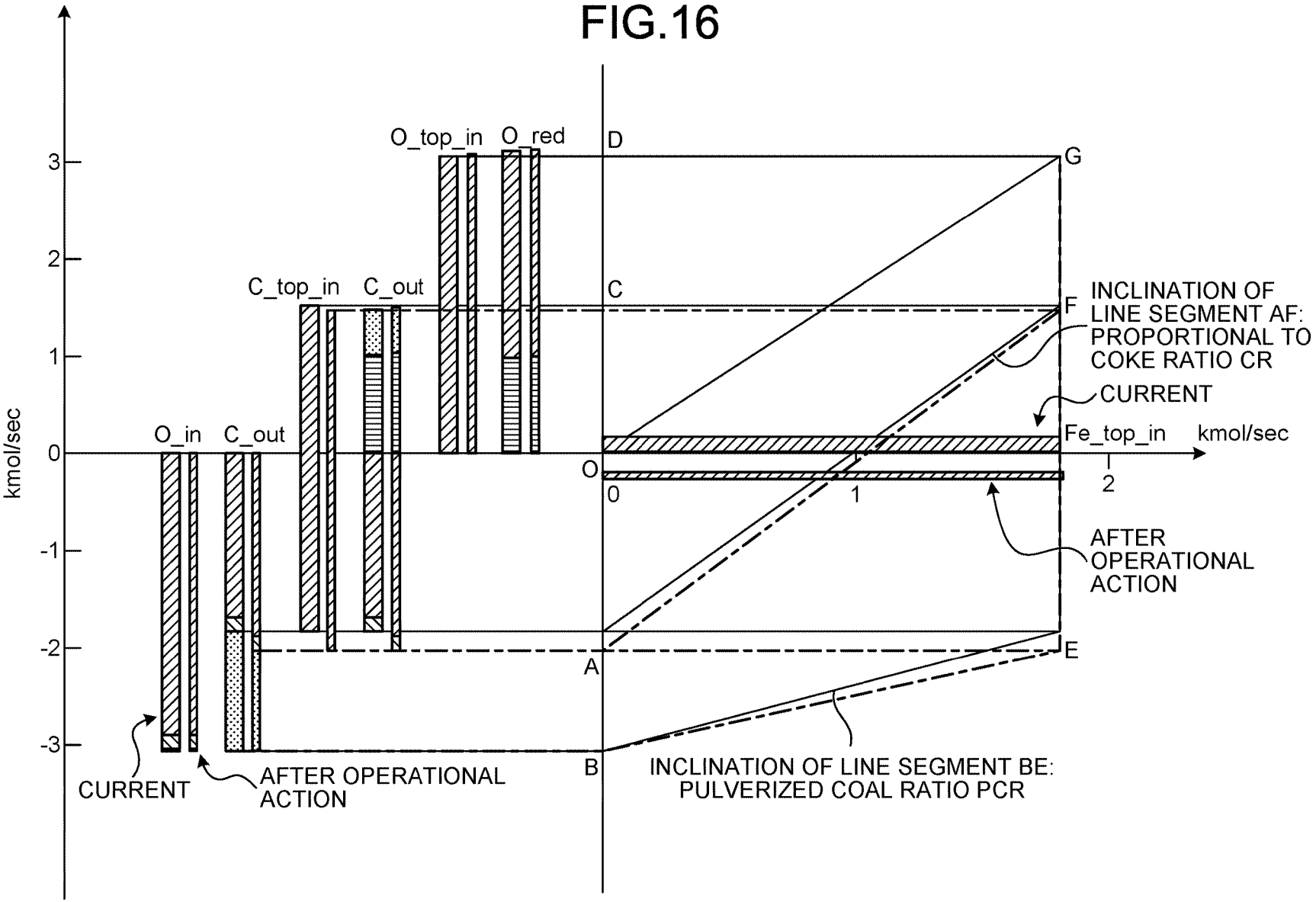
FIG. 16 is a graph illustrating the material balance in the furnace per unit time, values before and after increasing the coke ratio, and values after decreasing a pulverized coal flow rate.
Figure 18:
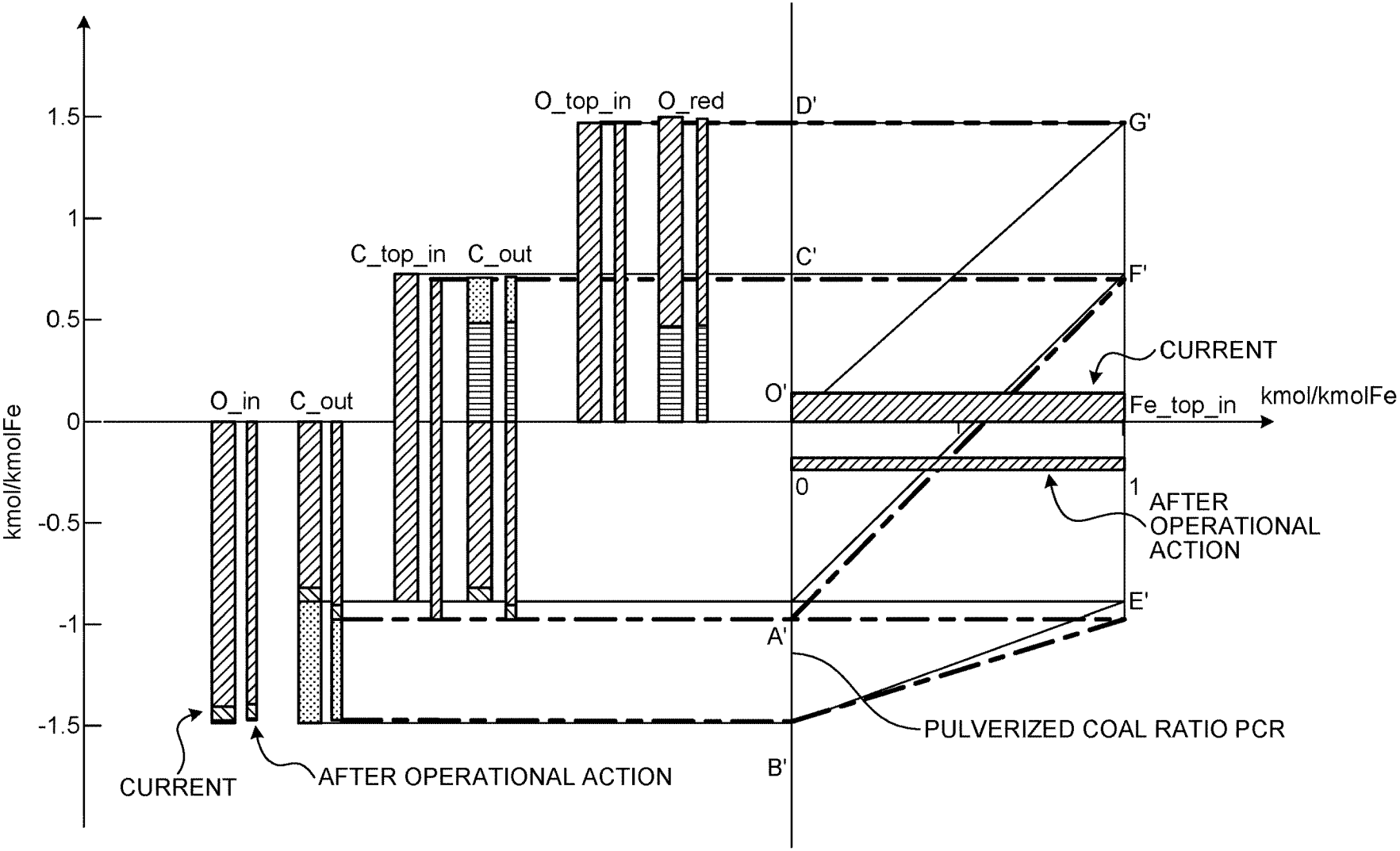
FIG. 18 is a graph illustrating the material balance in the furnace per unit weight of hot metal, values before and after increasing the coke ratio, and values after decreasing the pulverized coal flow rate.

In addition, when the second prediction step is performed in addition to the first prediction step, the oxygen balance in the raceway region, the carbon balance in the entire furnace, and the oxygen balance derived from iron oxide in the entire furnace are displayed in this step as follows. In other words, with respect to these balances, the current state and the state when the current operation state is retained in the future or the state when the operation is performed under the virtual operating conditions are displayed side by side in a graph in a comparable manner along the same axis direction in this step (FIGS. 16 and 18). As a result, the material balance in the furnace when the operation is performed under the virtual operating conditions can be visually presented to the operator, so that the operator can be easily guided to take an appropriate operational action.

In addition, in this step, the oxygen balance in the raceway region, the carbon balance in the entire furnace, and the oxygen balance derived from iron oxide in the entire furnace are displayed side by side in a first axis direction on the graph, except for the charging speed of iron derived from iron oxide. Then, the charging speed of iron derived from iron oxide is displayed in a second axis direction orthogonal to the first axis direction (FIGS. 11, 13, 16, and 18). In other words, when there are values proportional to each other among balance values, these values are arranged and presented on different axes instead of the same axis. As a result, it is possible to present the relationship between the balance values to the operator, so that the operator can be easily guided to take an appropriate operational action.

Still more, in this step, the following information may be displayed in addition to the oxygen balance in the raceway region, the carbon balance in the entire furnace, and the oxygen balance derived from iron oxide. In other words, in addition to these balances, the heat balance in the furnace indicating a relationship between the heat input into the furnace and the heat consumed in the furnace may be displayed on the output device 103 (FIGS. 12, 14, 17, and 19) and presented to the operator in this step. This makes it possible to visually present the heat balance in the furnace to the operator. Accordingly, the operator can be easily guided to take an appropriate operational action.

Still more, in this step, the oxygen balance in the raceway region, the carbon balance in the entire furnace, the oxygen balance derived from iron oxide, and the heat balance in the furnace may be displayed per unit time (FIGS. 11, 12, 16, and 17). Alternatively, in this step, each balance may be converted and displayed per unit weight of hot metal (FIGS. 14, 15, 18, and 19). As described above, by converting and indicating the material balance and the heat balance in the furnace per unit weight of hot metal, an amount of pulverized coal, an amount of coke, an amount of solution loss carbon, and a sensible heat of hot metal and slag per unit weight of hot metal can be presented to the operator.

Furthermore, in this step, changes before and after the prediction of operation indexes, including the hot metal making rate, the coke ratio, and the pulverized coal flow ratio, of the operation state predicted in at least one of the first prediction step and the second prediction step are displayed in a comparable manner (FIGS. 11, 13, 16, and 18). As a result, changes before and after the prediction of the operation state and an operation index can be visually presented to the operator, so that the operator can be easily guided to take an appropriate operational action.

[Details of Each Balance]

Hereinafter, details of each balance calculated in the balance calculation step and displayed in the display step will be described.

(Oxygen Balance in Raceway Region)

First, the oxygen balance in the raceway region will be described. Oxygen blown into the raceway region includes blast air (including enriched oxygen), blast air moisture, and oxygen in pulverized coal. Respective supply (charging) speeds [kmolO/sec] are defined as O_in(1), O_in(2), and O_in(3). Carbon burned in the raceway region is derived from coke or pulverized coal. Therefore, reaction between oxygen and carbon in the raceway region is represented by one of the following formulas (3) to (6).

$$C(coke)+\tfrac{1}{2}O_2=CO \quad (3)$$

$$C(coke)+H_2O=CO+H_2 \quad (4)$$

$$C(coal)+\tfrac{1}{2}O_2=CO \quad (5)$$

$$C(coal)+O(coal)=CO \quad (6)$$

Here, a carbon consumption speed according to the above formula (3) is defined as C_out(1), a carbon consumption speed according to the above formula (4) is defined as C_out(2), and carbon consumption speed according to the above formulas (5) and (6) are defined as C_out(3). In any of reaction forms of the above formulas (3) to (6), the supply speed of oxygen [kmolO/sec] blown into the raceway region has to coincide with the consumption speed of carbon [kmolC/sec] as represented by the following formula (7) because a molar ratio of C to O is 1:1.

$$O_in(1)+O_in(2)+O_in(2)=C_out(1)+C_out(2)+C_out(3) \quad (7)$$

FIG. 3 is a bar graph illustrating a balance relationship expressed by the above formula (7).

(Carbon Balance in Entire Furnace)

Next, the carbon balance in the coke in the entire furnace will be described. In addition to the carbon consumed according to the above formulas (3) and (4) in the raceway region, carbon is consumed by reactions represented by the following formulas (8) to (12) in the furnace.

$$C(coke)=[C] \quad (8)$$

$$C+CO_2=2CO \quad (9)$$

$$C+H_2O=CO+H_2 \quad (10)$$

$$FeO+C=Fe+CO \quad (11)$$

$$(SiO_2)+2C=[Si]+2CO \quad (12)$$

Here, a carbon consumption speed according to the above formula (8) is defined as C_out(4), and carbon consumption speed according to the above formulas (9) to 5 (12) are defined as C_out(5). In addition, when the supply speed of carbon derived from coke supplied from the furnace top (hereinafter referred to as "supply speed of carbon supplied from furnace top") is C_top_in, the carbon consumption speed is equal to the carbon supply speed in the steady state, and the following formula (13) is established.

$$C_top_in=C_out(1)+C_out(2)+C_out(4)+C_out(5) \quad (13)$$

However, it is necessary to note that the above formula (13) is not established in a transient state such as immediately after changing the coke ratio. FIG. 4 is a bar graph illustrating a balance relationship between the carbon supply speed and the carbon consumption speed indicated by the above formula (13).

In addition, the following relationship is established between C_top_in that is the supply speed of carbon supplied from the furnace top and Fe_top_in that is a supply speed of Fe derived from iron oxide in the ore (hereinafter referred to as "supply speed of Fe in ore"). In other words, a proportional relationship represented by the following Formula (14) is established between C_top_in and Fe_top_in by using a coke ratio CR [kg/t] that is the operation variable of the operator.

$$C_top_in/Fe_top_in \propto CR \quad (14)$$

(Oxygen Balance Derived from Iron Oxide)

Next, the oxygen balance derived from iron oxide will be described. Oxygen derived from iron oxide in the ore is reduced by any one of reactions represented by the following formulas (15) to (17).

$$FeO+C=Fe+CO \quad (15)$$

$$FeO_x+CO=FeO_{x-1}+CO_2 \quad (16)$$

$$FeO_x+H_2O=FeO_{x-1}+H_2O \quad (17)$$

On the other hand, reactions represented by the above formulas (9) and (10) also occur to restore $CO_2$ and $H_2O$ generated by the reactions represented by the above formulas (15) to (17) to CO and $H_2$ gases.

Here, a value obtained by subtracting a reaction speed O_red(1) of direct reduction represented by the sum of the above formulas (9), (10), and (15) from a reduction speed O_red(0) of iron oxide in the ore represented by the sum of the above formulas (15) to (17) is set as a gas reduction reaction speed O_red(2)=0 red(0)−O_red(1). In addition, when the supply speed of oxygen derived from iron oxide in the ore (hereinafter referred to as "supply speed of oxygen in ore") supplied from the furnace top is indicated as O_top_in, the oxygen balance as represented by the following formula (18) is established in the steady state.

$$O_top_in=O_red(1)+O_red(2) \quad (18)$$

Further, a proportional relationship as represented by the following formula (19) is established between Fe_top_in that is the supply speed of Fe in ore and O_top_in that is the supply speed of oxygen in ore described above when an ore oxidation degree a (approximately 1.5) at the furnace top is used.

$$O_top_in=a\times Fe_top_in \quad (19)$$

Figure 6:
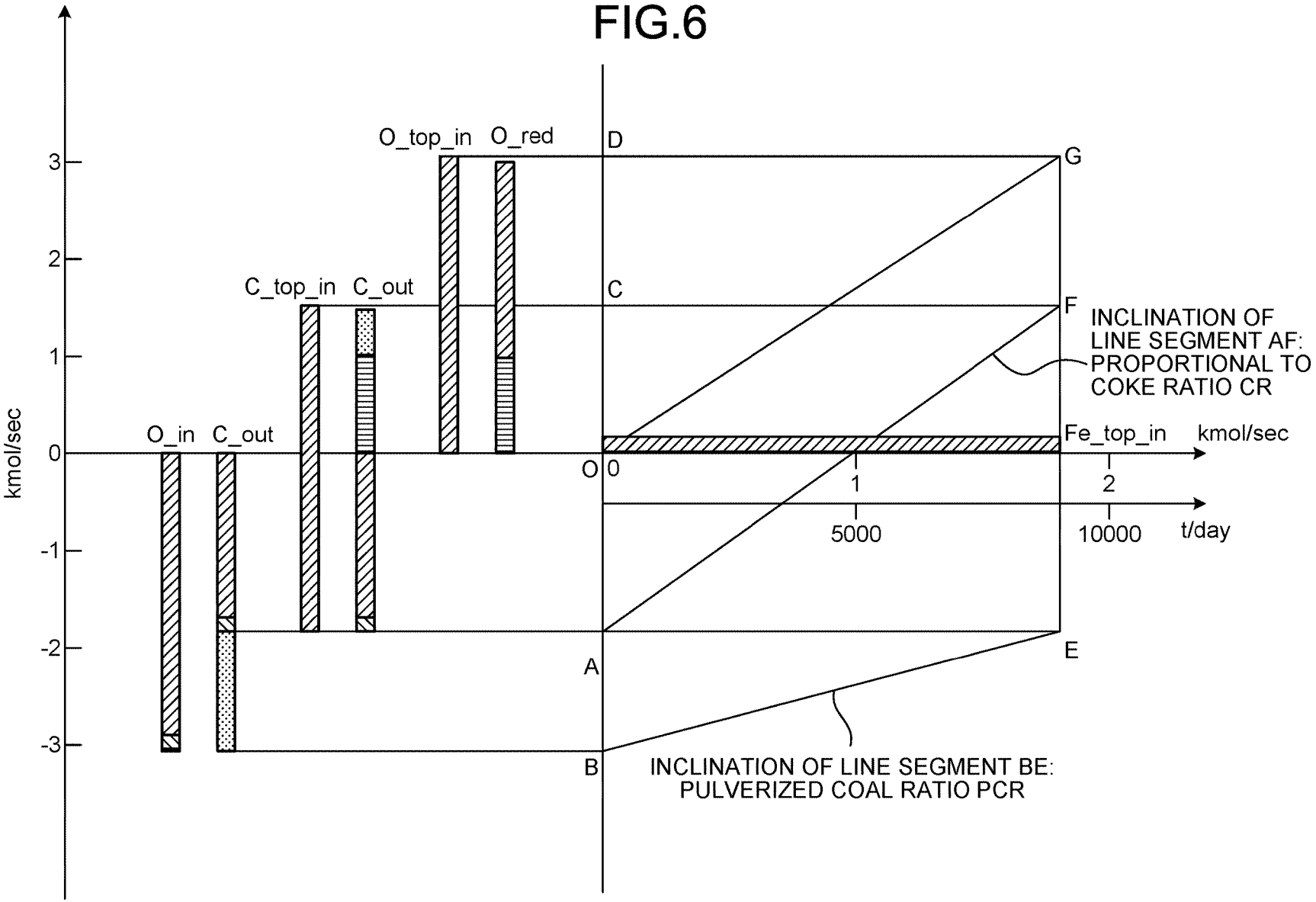
FIG. 6 is a graph illustrating a material balance in a furnace per unit time.

FIG. 5 is a bar graph illustrating the supply speed of oxygen in the ore, the supply speed of Fe in the ore, and the gas reduction reaction speed. FIG. 6 is obtained by integrating the oxygen balance in the raceway region, the carbon balance derived from coke in the entire furnace, and the oxygen balance derived from iron oxide in the entire furnace illustrated in FIGS. 3 to 5. FIG. 6 illustrates a value of the material balance in the furnace per unit time. In addition, in a vertical axis of FIG. 6, a positive side indicates an increase of value in the furnace, and a negative side indicates a decrease of value in the tuyere. In addition, as illustrated in FIG. 6 a line segment connecting respective balance values (e.g., a line segment OG, a line segment AF, and a line segment BE) may be clearly indicated, or a meaning of an inclination of a line segment BE, which is the pulverized coal ratio PCR, may be clearly indicated in the graph. As described above, by clearly indicating the operation variable associated with the value of each balance in the graph, it is possible to visually present, for example, a factor causing a change in the hot metal making rate and the hot metal temperature to the operator.

An inclination of a line segment AF in FIG. 6 is proportional to the coke ratio CR expressed by the above formula (14). An inclination of the line segment BE means the amount of carbon in the pulverized coal per charged iron mole, and is proportional to the pulverized coal ratio. In addition, an inclination of the line segment OG is a in the above formula (19), which means a proportional constant of Fe_top_in that is the supply speed of Fe in the ore and O_top_in that is the supply speed of oxygen in the ore.

By presenting the current material balance and the material balance when the operator changes the operation variable using an integrated graph of the material balance in the furnace, it is possible to quantitatively grasp the change in the hot metal making rate [t/min] when the operator changes the operation variable (FIGS. 16 and 18).

For example, when only the pulverized coal flow rate is increased while retaining other operation variables, a line segment AB becomes long while a length of a line segment OB remains unchanged, so that the carbon consumption speed in the raceway region represented by a length of a line segment OA decreases. Therefore, a line segment CA corresponding to the supply speed of carbon supplied from the furnace top (C_top_in) is also shortened. As a result, a line segment CF corresponding to the supply speed of Fe in the ore supplied from the furnace top (Fe_top_in) is also shortened in proportion to the line segment CA, and thus the hot metal making rate decreases.

(Heat Balance in Furnace)

Next, the heat balance in the furnace will be described. Heat input into the furnace is derived from combustion heat of coke and pulverized coal at the tuyere, indirect reduction heat in the furnace, and blast sensible heat. These are defined as Q_in(1), Q_in(2), and Q_in(3), respectively. The heat consumed in the furnace is classified into sensible heat of hot metal and slag, direct reduction reaction heat, gasification reaction heat of coke due to blast air moisture, heat loss released from the furnace wall to cooling water or the atmosphere, sensible heat of gas discharged from the furnace top, and the like. These are respectively defined as Q_out(1), Q_out(2), Q_out(3), Q_out(4), and Q_out(5).

These are illustrated by bar graphs in FIG. 7. FIG. 7 illustrates a value of the heat balance in the furnace per unit time. The heat balance in the furnace satisfies a relationship of the following formula (20) in the steady state.

$$Q_in(1)+Q_in(2)+Q_in(3)=Q_out(1)+Q_out(2)+Q_out(3)+Q_out(4)+Q_out(5) \quad (20)$$

Figure 8:
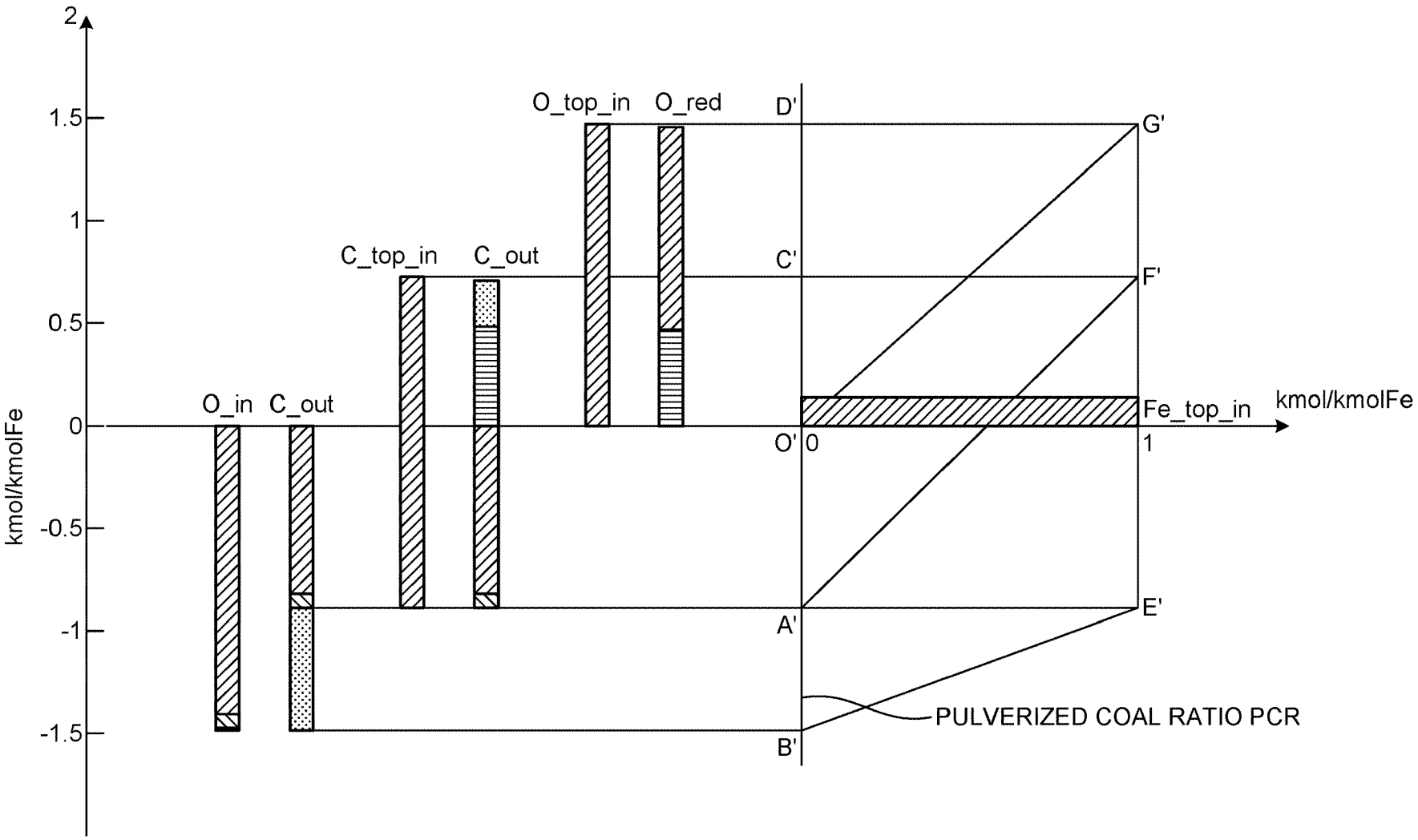
FIG. 8 is a graph illustrating a material balance in the furnace per unit weight of hot metal.
Figure 9:
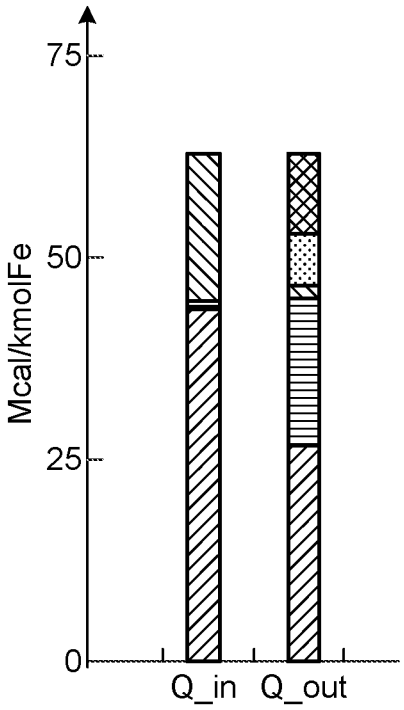
FIG. 9 is a graph illustrating a heat balance in the furnace per unit weight of hot metal.

Here, the material balance and the heat balance in the furnace illustrated in FIGS. 6 and 7 are values per unit time On the other hand, in order to obtain a hot metal temperature substantially proportional to the hot metal sensible heat per unit weight of hot metal, a reduction material ratio that is an amount of carbon material per unit weight of hot metal, and the like, it is necessary to obtain the material balance and the heat balance per unit weight of hot metal. Therefore, values obtained by dividing the variables illustrated in FIGS. 6 and 7 by Fe_top_in (the supply speed of Fe in the ore supplied from the furnace top) are illustrated in FIGS. 8 and 9. As described above, by converting and indicating the material balance and the heat balance in the furnace per unit weight of hot metal, an amount of pulverized coal, an amount of coke, an amount of solution loss carbon, and a sensible heat of hot metal and slag per unit weight of hot metal can be presented to the operator.

[Specific Example of First Prediction Step]

Hereinafter, a specific example of the first prediction step of the operation guidance method will be described. First, on the assumption that the operation amounts of all the current operation variables are kept constant, prediction calculation of the future hot metal temperature and the future hot metal making rate is performed. Specifically, the current time step is set to t=0, and the future hot metal temperature and the future hot metal making rate are calculated using the following Formulas (21) and (22).

$$x(t+1)=f(x(t),u(0)) \quad (21)$$

$$y_0(t)=C(x(t)) \quad (22)$$

A response $y_0$ of the control variable (here, the hot metal temperature and the hot metal making rate) obtained in this manner is referred to as a "free response" in the present embodiment. The free response of the hot metal making rate and the hot metal temperature when the operational action of increasing the coke ratio was carried out two hours before is indicated by solid lines in FIGS. 10(*c*) and 10(*d*). As illustrated in the graphs, by increasing the coke ratio, the hot metal making rate decreases by about 1000 t/day, and the hot metal temperature increases by about 100° C.

Figure 12:
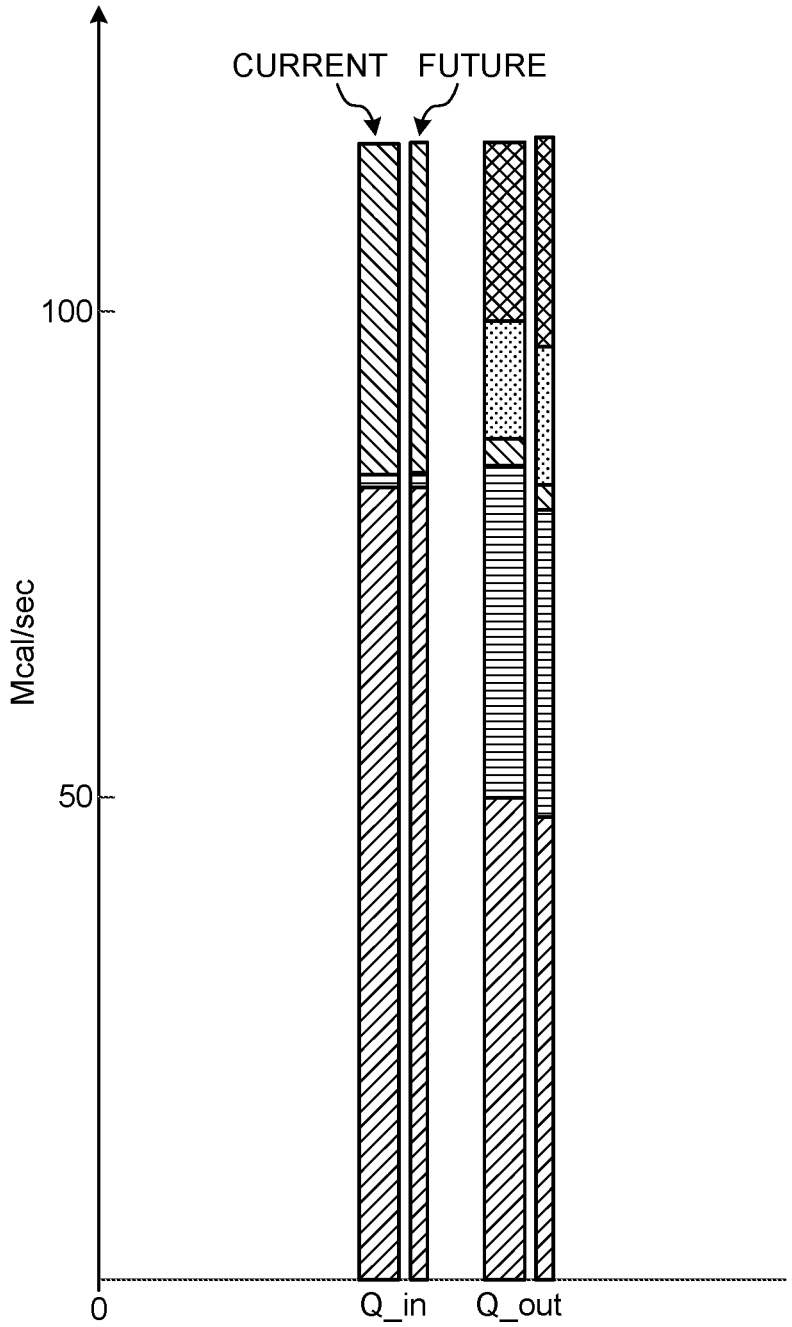
FIG. 12 is a graph illustrating the heat balance in the furnace per unit time and values before and after increasing the coke ratio.

In addition, in FIGS. 11 and 12, bar graphs of the material balance and the heat balance in the furnace state predicted in the first prediction step are arranged next to the bar graphs of the material balance and the heat balance in the furnace illustrated in FIGS. 8 and 9.

In FIGS. 11 and 12, the left side indicates a value immediately before increasing the coke ratio (current state) in each of the bar graphs indicating O_in, C_out, C_top_in, C_out, O_top_in, O_red, Q_in, and Q_out. The right side of each bar graph indicates a value after 12 hours from the increase of the coke ratio. Also in FIG. 11, an upper graph is a value immediately before (current state) increasing the coke ratio, and a lower graph is a value 12 hours after increasing the coke ratio in bar graphs indicating Fe_top_in.

In FIG. 11, a reason that a length of a line segment AE representing the hot metal making rate is decreased is that the inclination of the line segment AF proportional to the coke ratio has increased and a length of the line segment CA corresponding to the supply speed of carbon supplied from the furnace top (C_top_in) has shortened. In addition, the increase in the inclination of the line segment AF is a direct effect of increasing the coke ratio. As a result, the line segment AE corresponding to the hot metal making rate is shortened. In addition, since the supply speed (O_top_in) of oxygen in the ore supplied from the furnace top decreases in proportion thereto, the consumption speed of carbon by direct reduction also decreases. Furthermore, since a carburizing speed substantially proportional to the hot metal making rate also decreases, a length of a line segment CO also decreases. Therefore, the line segment CA corresponding to the carbon supply speed (C_top_in) from the furnace top is shortened, and the hot metal making rate further decreases.

In addition, as illustrated in FIG. 12, it is apparent that there is no change in the total amount and breakdown of the amount of heat per unit time supplied to the furnace, but heat loss and gas sensible heat at the furnace top increase while the sensible heat of hot metal and slag decreases.

Figures 14, 15:
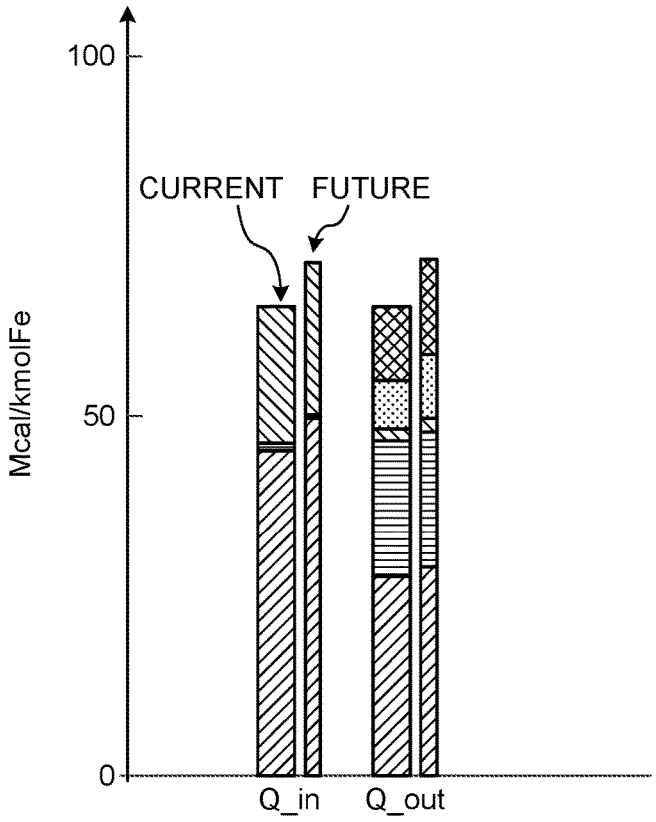
FIG. 14 is a graph illustrating the heat balance in the furnace per unit time values before and after increasing the coke ratio.
FIG. 15 is a diagram illustrating an example of an input interface that can designate arbitrary values of a plurality of operation variables.

In addition, FIGS. 13 and 14 illustrate results of converting the material balance and the heat balance in the furnace per unit time, illustrated in FIGS. 11 and 12, into those per unit weight of hot metal. As illustrated in FIG. 13, a line segment connecting respective balance values (e.g., a line segment O'G', a line segment A'F', and a line segment B'E') may be clearly indicated, or a meaning of the line segment A'B', which is the pulverized coal ratio PCR, may be clearly indicated in the graph.

As illustrated in FIG. 13, it is apparent that the line segment O'A' becomes longer after increasing the coke ratio. This means that since the coke ratio was increased, the amount of coke per unit weight of hot metal at a tuyere height has increased after undergoing direct reduction and carburization reaction in the furnace. In addition, the line segment A'B' indicating the pulverized coal ratio is also extended. This is because, similar to FIG. 11, the pulverized coal amount per unit weight of hot metal has increased due to a decrease in the hot metal making rate while the pulverized coal flow rate remains unchanged.

Further, as illustrated in FIG. 14, since the hot metal making rate decreases, an amount of heat supplied per unit weight of hot metal increases both in blast sensible heat and in carbon combustion heat at the tuyere. In addition, it is apparent that the hot metal temperature increases since the amount per unit weight of hot metal also increases with respect to the sensible heat of hot metal and slag per unit time that has decreased in FIG. 12. As described above, by presenting the material balance and the heat balance per unit time and per unit weight of hot metal in the graphs, it is possible for the operator to consider a cause of change in the hot metal making rate and the hot metal temperature.

[Specific Example of Second Prediction Step]

Hereinafter, a specific example of the second prediction step will be described. By performing the first prediction step described above and presenting the material balance and the heat balance in the furnace based on the results, it is possible to foresee future changes in the in-furnace state and control variables. However, it is necessary for the operator to take an appropriate operational action in response to the changes. For example, in FIG. 10, it is predicted that the hot metal temperature will rise to near 1600° C., which is excessive. Therefore, by performing the second prediction step, the future material balance and heat balance in the furnace when the operator virtually changes the operation variable can also be presented.

The operation variables (virtual operation variables) that can be operated by the operator are, as described above, the blast air flow rate, the enriched oxygen flow rate, the pulverized coal flow rate, the coke ratio, the blast air moisture, and the blast temperature. Therefore, for example, as illustrated in FIG. 15, the input interface capable of designating an arbitrary value of each operation variable is displayed on the output device 103, and the future state in the blast furnace is predicted based on the operation variable designated by the input interface. Specifically, an operation variable u1 is designated by the input interface, and future prediction under the virtual operating condition is performed, for example, by the following formulas (23) and (24).

$$x(t+1)=f(x(t),u_1) \tag{23}$$

$$y_1(t)=C(x(t)) \tag{24}$$

Figure 10:
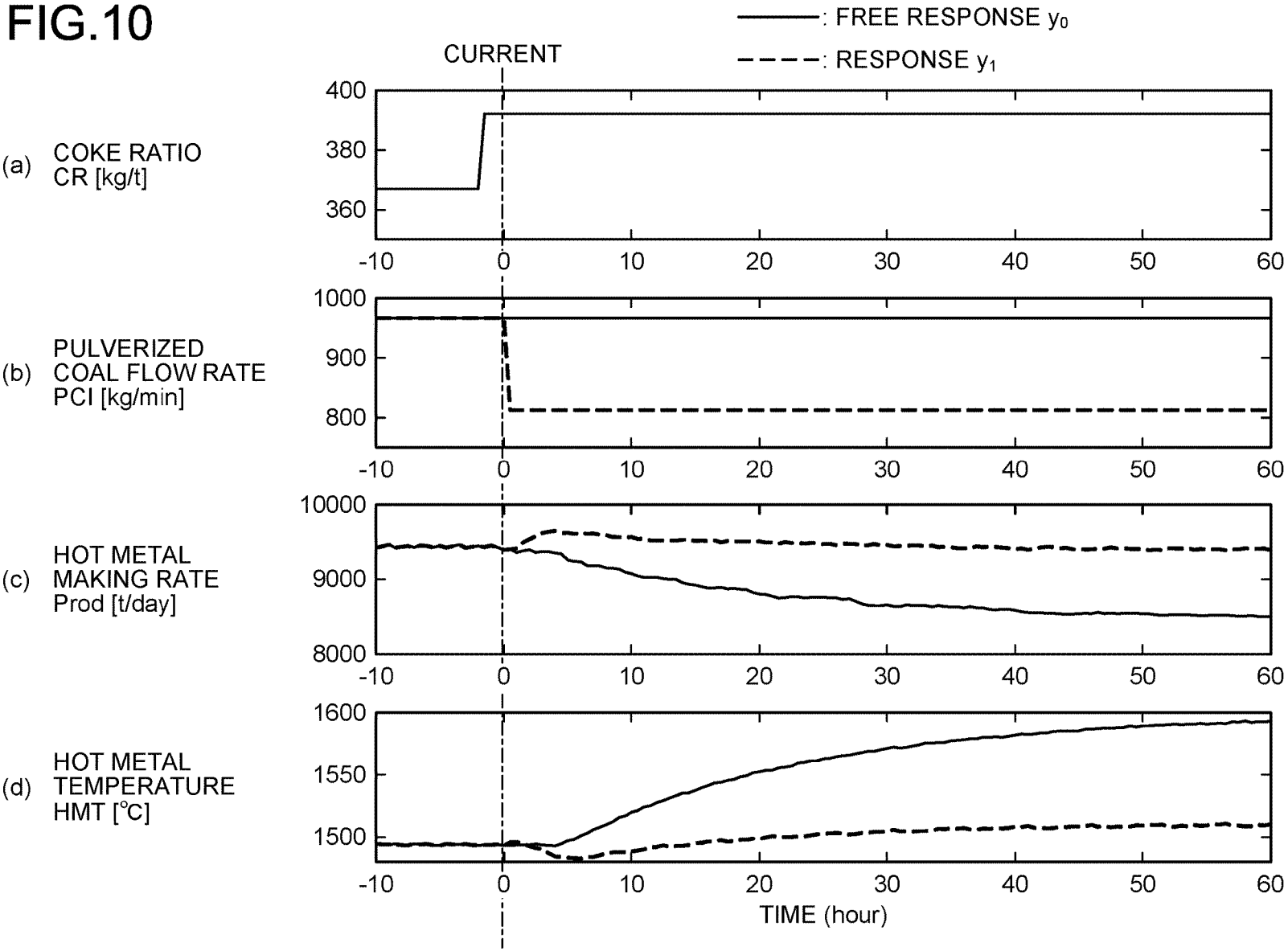
FIG. 10 is a diagram illustrating a prediction result of an ironmaking temperature and a hot metal temperature by a physical model in the operation guidance method according to the embodiment of the present invention.

For example, as illustrated in FIG. 10 described above, it is considered that the pulverized coal flow rate is decreased to keep the hot metal temperature in an appropriate range at the timing two hours after the coke ratio is increased. Here, the operator manipulates the value of the pulverized coal flow rate PCI in FIG. 15 to decrease the pulverized coal flow rate by 150 kg/min, and the results (response $y_1$) of predicting the hot metal making rate and the hot metal temperature by the above Formulas (23) and (24) are indicated by broken lines in FIGS. 10(*c*) and 10(*d*). As illustrated in the graphs, it is apparent that when the operator performs the operation to decrease the pulverized coal flow rate, the hot metal temperature, which was excessive due to the increase in the coke ratio, can be returned to an appropriate level.

Figure 17:
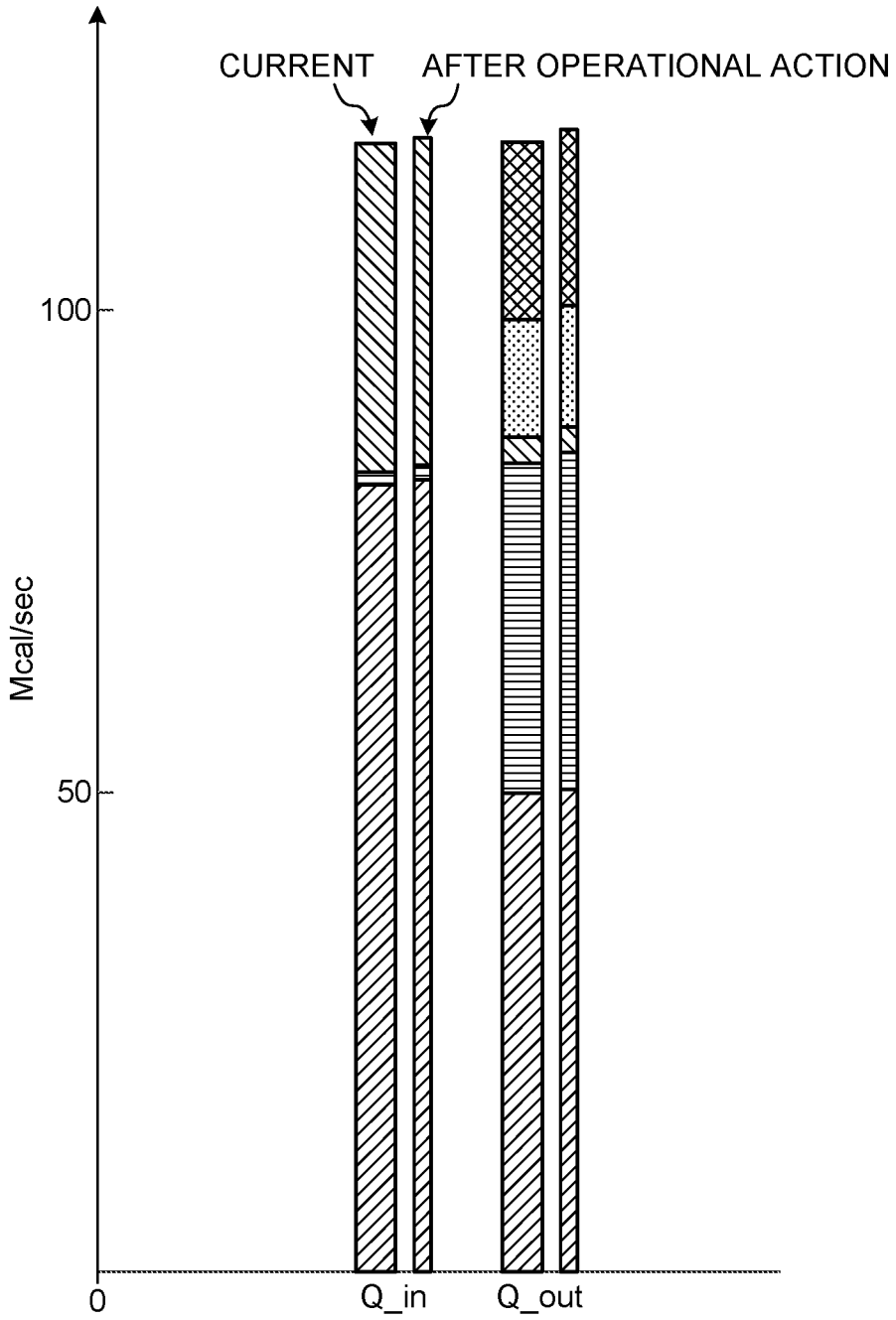
FIG. 17 is a graph illustrating the heat balance in the furnace per unit time, values before and after increasing the coke ratio, and values after decreasing the pulverized coal flow rate.
Figure 19:
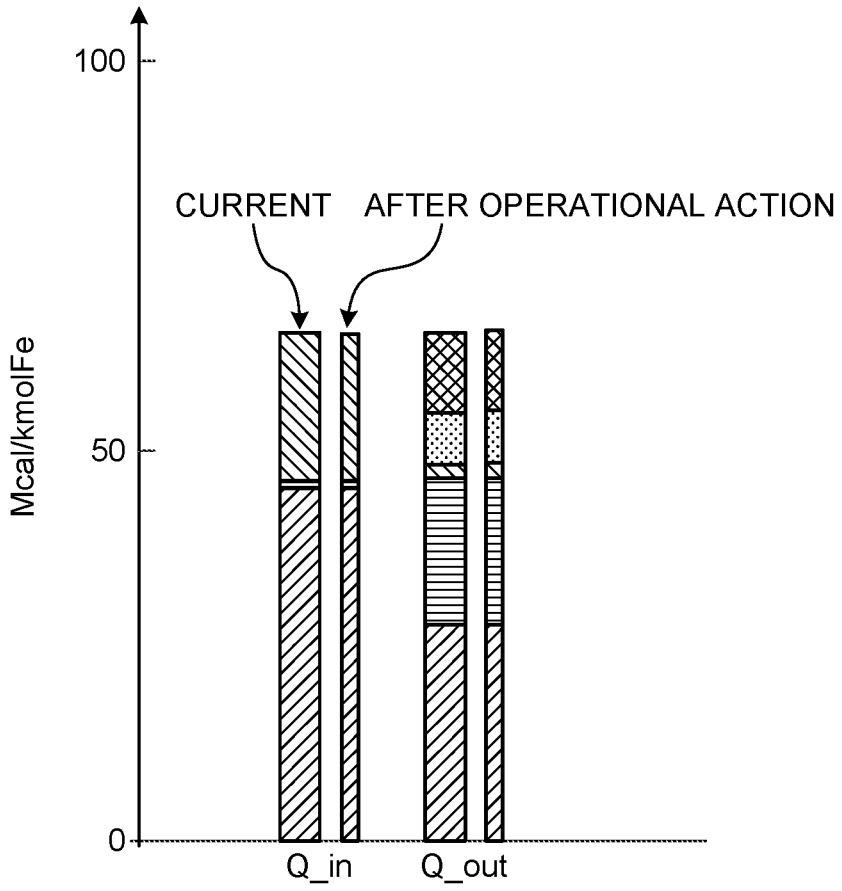
FIG. 19 is a graph illustrating the heat balance in the furnace per unit time, values before and after increasing the coke ratio, and values after decreasing the pulverized coal flow rate.

In addition, with respect to the bar graphs illustrated in FIGS. 11 and 12, the bar graphs of the material balance and the heat material balance in the in-furnace state predicted in the first prediction step are replaced with bar graphs of the material balance and the heat balance in the in-furnace state predicted in the second prediction step. These bar graphs are illustrated in FIGS. 16 to 19. FIG. 16 is a graph illustrating the material balance in the furnace per unit time, FIG. 17 is a graph illustrating the heat balance in the furnace per unit time, FIG. 18 is a graph illustrating the material balance in the furnace per unit weight of hot metal, and FIG. 19 is a graph illustrating the heat balance in the blast furnace per unit weight of hot metal.

In FIGS. 16 to 19, the left side of each of graphs indicating O_in, C_out, C_top_in, C_out, O_top_in, O_red, Q_in, and Q_out is a value immediately before increasing the coke ratio (current state). The right side of each of the graphs is a value after the virtual operational action is performed. In the same graphs, an upper graph is a value immediately before (current state) increasing the coke ratio, and a lower graph is a value after performing the virtual operational action in the bar graphs indicating Fe_top_in.

When FIG. 11 and FIG. 16 are compared, it is apparent that the supply speed (C_top_in) of carbon supplied from the furnace top is increased by decreasing the pulverized coal flow rate and increasing the carbon consumption speed at the tuyere. As a result, the hot metal making rate decreased due to the increase in the coke ratio can be recovered to a level before the increase in the coke ratio.

In addition, since the hot metal making rate increases and the pulverized coal flow rate decreases, the inclination of the line segment BE in FIG. 16 representing the pulverized coal ratio and a length of a line segment A'B' in FIG. 18 decrease, and thus, an increase in sensible heat of hot metal and slag due to the increase in the coke ratio is compensated. As a result, as indicated by a broken line in FIG. 10(*d*), the hot metal temperature can be maintained at a value substantially equivalent to the level before the increase in the coke ratio.

In addition, FIGS. 16 to 19 exemplify a most typical operational action of decreasing the pulverized coal flow rate with respect to a decrease in the hot metal making rate and an increase in the hot metal temperature due to the increase in the coke ratio. In addition, for example, it is possible to achieve a similar control purpose by increasing the blast air flow rate or the oxygen flow rate. A solution of a combined action by operation variables is also conceivable.

(Blast Furnace Operation Method)

The operation guidance method according to the present embodiment can also be applied to an operation method of the blast furnace. In this case, in addition to the first prediction step, the second prediction step, the balance calculation step and the display step in the operation guidance method described above, a step of controlling the blast furnace according to the guidance in the display step is included.

[Hot Metal Manufacturing Method]

The operation guidance method according to the present embodiment can also be applied to a hot metal manufacturing method. In this case, in addition to the first prediction step, the second prediction step, the balance calculation step, and the display step in the operation guidance method described above, a step of manufacturing hot metal by controlling the blast furnace according to the guidance in the display step is performed.

According to the operation guidance method, the blast furnace operation method, the hot metal manufacturing method, and the operation guidance apparatus according to the present embodiment as described above, the oxygen balance in the raceway region, the carbon balance in the entire furnace, and the oxygen balance derived from iron oxide in the entire furnace when the state in the blast furnace is predicted are displayed. As a result, the operator is guided to take an appropriate operational action. Therefore, a highly efficient and stable operation of the blast furnace can be realized.

In addition, according to the operation guidance method, the blast furnace operation method, the hot metal manufacturing method, and the operation guidance apparatus according to the present embodiment, the prediction result of the in-furnace state under the virtual operating conditions designated by the operator or the future prediction result without any operation can be presented together with the material balance and the heat balance. As a result, the operator can quantitatively and reasonably grasp the effect of the operational action and reach an appropriate operational action by himself/herself.

Although the operation guidance method, the blast furnace operation method, the hot metal manufacturing method, and the operation guidance apparatus according to the present invention have been specifically described with reference to the embodiments and examples for carrying out the invention, the gist of the present invention is not limited to these descriptions and has to be broadly interpreted based on the description of the claims. It is obvious that various changes and modifications based on the descriptions are also included in the gist of the present invention.

REFERENCE SIGNS LIST

100 OPERATION GUIDANCE APPARATUS
101 INFORMATION PROCESSING DEVICE
102 INPUT DEVICE
103 OUTPUT DEVICE
111 RAM
112 ROM
112*a* CONTROL PROGRAM
113 CPU

The invention claimed is:

1. An operation guidance method comprising:

predicting a state in a blast furnace when a current operation state is retained in a future, by using a physical model that is able to calculate the state in the blast furnace; and displaying, on an output device, an oxygen balance in a raceway region, a carbon balance in an entire furnace, and an oxygen balance derived from iron oxide in the entire furnace, when the state in the blast furnace is predicted, wherein the state in the blast furnace includes a hot metal temperature, a hot metal making rate, air permeability of the blast furnace, and a pressure loss indicating a difference between a pressure at a furnace top and a pressure at a tuyere, and in the displaying, a current state and the state when the current operation state is retained in the future are displayed side by side along a same first axis direction in one graph with respect to the oxygen balance in the raceway region, the carbon balance in the entire furnace, and the oxygen balance derived from iron oxide in the entire furnace.

2. The operation guidance method according to claim 1 further comprising further predicting, by using the physical model, a future state in the blast furnace when an operation is performed under an arbitrary virtual operating condition which is input by an operator, wherein in the displaying, the current state and a state when the operation is performed under the virtual operating condition are displayed side by side along the first axis direction in the graph with respect to the oxygen balance in the raceway region, the carbon balance in the entire furnace, and the oxygen balance derived from iron oxide in the entire furnace.

3. The operation guidance method according to claim 2, wherein in the further predicting, the output device displays an input interface that is able to designate an arbitrary value of a plurality of operation variables indicating the operating condition, and the future state in the blast furnace is predicted based on the plurality of operation variables designated by the input interface.

4. The operation guidance method according claim 1, wherein the oxygen balance in the raceway region indicates a relationship between a supply speed of oxygen blown into the raceway region and a consumption speed of carbon burned in the raceway region, the carbon balance in the entire furnace indicates a relationship between a supply speed of carbon derived from coke supplied from the furnace top and a consumption speed of carbon burned in a furnace, the oxygen balance derived from iron oxide in the entire furnace indicates a relationship among a charging speed of iron derived from iron oxide supplied from the furnace top, a charging speed of oxygen derived from iron oxide supplied from the furnace top, and a reduction reaction speed of iron oxide, by gas, supplied from the furnace top, and in the displaying, the oxygen balance in the raceway region, the carbon balance in the entire furnace, and the oxygen balance derived from iron oxide in the entire furnace, except for the charging speed of iron derived from iron oxide, are displayed side by side in the first axis direction in the graph, and the charging speed of iron derived from iron oxide is displayed in a second axis direction orthogonal to the first axis direction.

5. The operation guidance method according claim 2, wherein the oxygen balance in the raceway region indicates a relationship between a supply speed of oxygen blown into the raceway region and a consumption speed of carbon burned in the raceway region, the carbon balance in the entire furnace indicates a relationship between a supply speed of carbon derived from coke supplied from the furnace top and a consumption speed of carbon burned in a furnace, the oxygen balance derived from iron oxide in the entire furnace indicates a relationship among a charging speed of iron derived from iron oxide supplied from the furnace top, a charging speed of oxygen derived from iron oxide supplied from the furnace top, and a reduction reaction speed of iron oxide, by gas, supplied from the furnace top, and in the displaying, the oxygen balance in the raceway region, the carbon balance in the entire furnace, and the oxygen balance derived from iron oxide in the entire furnace, except for the charging speed of iron derived from iron oxide, are displayed side by side in the first axis direction in the graph, and the charging speed of iron derived from iron oxide is displayed in a second axis direction orthogonal to the first axis direction.

6. The operation guidance method according claim 3, wherein the oxygen balance in the raceway region indicates a relationship between a supply speed of oxygen blown into the raceway region and a consumption speed of carbon burned in the raceway region, the carbon balance in the entire furnace indicates a relationship between a supply speed of carbon derived from coke supplied from the furnace top and a consumption speed of carbon burned in a furnace, the oxygen balance derived from iron oxide in the entire furnace indicates a relationship among a charging speed of iron derived from iron oxide supplied from the furnace top, a charging speed of oxygen derived from iron oxide supplied from the furnace top, and a reduction reaction speed of iron oxide, by gas, supplied from the furnace top, and in the displaying, the oxygen balance in the raceway region, the carbon balance in the entire furnace, and the oxygen balance derived from iron oxide in the entire furnace, except for the charging speed of iron derived from iron oxide, are displayed side by side in the first axis direction in the graph, and the charging speed of iron derived from iron oxide is displayed in a second axis direction orthogonal to the first axis direction.

7. The operation guidance method according to claim 2, wherein in the displaying, changes before and after prediction of an operation index, predicted in at least one of the predicting and the further predicting, are displayed side by side along the first axis direction in the graph, where the operation index includes an operation state of: the hot metal making rate; a coke ratio; and a pulverized coal flow ratio.

8. The operation guidance method according to claim 3, wherein in the displaying, changes before and after prediction of an operation index, predicted in at least one of the predicting and the further predicting, are displayed side by side along the first axis direction in the graph, where the operation index includes an operation state of: the hot metal making rate; a coke ratio; and a pulverized coal flow ratio.

9. The operation guidance method according to claim 1, wherein the displaying includes displaying a heat balance in the furnace indicating a relationship between heat input into the furnace and heat consumed in the furnace, in addition to the oxygen balance in the raceway region, the carbon balance in the entire furnace, and the oxygen balance derived from iron oxide in the entire furnace.

10. The operation guidance method according to claim 1, wherein the displaying displays each balance by converting each balance in terms of a value per unit weight of hot metal by dividing each balance by a supply speed of Fe in an ore supplied from the furnace top.

11. The operation guidance method according to claim 9, wherein the displaying displays each balance by converting each balance in terms of a value per unit weight of hot metal by dividing each balance by a supply speed of Fe in an ore supplied from the furnace top.

12. A blast furnace operation method comprising controlling a blast furnace based on guidance according to the operation guidance method according to claim 1.

13. A hot metal manufacturing method comprising manufacturing hot metal by controlling a blast furnace based on guidance according to the operation guidance method according to claim 1.

14. An operation guidance apparatus comprising:

a prediction unit configured to predict a state in a blast furnace when a current operation state is retained in a future, by using a physical model that is able to calculate the state in the blast furnace; and a display unit configured to display an oxygen balance in a raceway region, a carbon balance in an entire furnace, and an oxygen balance derived from iron oxide in the entire furnace, when the state in the blast furnace is predicted, wherein the state in the blast furnace includes a hot metal temperature, a hot metal making rate, air permeability of the blast furnace, and a pressure loss indicating a difference between a pressure at a furnace top and a pressure at a tuyere, and the display unit displays a current state and the state when the current operation state is retained in the future side by side along a same axis direction in one graph with respect to the oxygen balance in the raceway region, the carbon balance in the entire furnace, and the oxygen balance derived from iron oxide in the entire furnace.

* * * * *